US006425564B1

(12) United States Patent
Harnik

(10) Patent No.: US 6,425,564 B1
(45) Date of Patent: Jul. 30, 2002

(54) SPRINKLER HEAD INSTALLATION TOOL

(76) Inventor: Joshua Harnik, Tucker Rd., Limington, ME (US) 04049

( * ) Notice: Subject to any disclaimer, the term of this patent is extended or adjusted under 35 U.S.C. 154(b) by 0 days.

(21) Appl. No.: 09/387,526

(22) Filed: Sep. 1, 1999

(51) Int. Cl.[7] ..... E04G 3/00

(52) U.S. Cl. ..... 248/274.1; 248/85; 248/229.22; 239/201; 405/184.4

(58) Field of Search ..... 248/274.1, 57, 248/228.1, 85, 87, 88, 86, 229.12, 229.22, 230.3, 231.41; 239/201, 288; 405/41, 157, 184.4

(56) References Cited

U.S. PATENT DOCUMENTS

| | | | | | |
|---|---|---|---|---|---|
| 152,825 | A | | 7/1874 | Brown | |
| 858,140 | A | * | 6/1907 | Beaton | 248/57 |
| 2,751,250 | A | * | 6/1956 | Block | 239/201 |
| 3,015,448 | A | * | 1/1962 | Hurless | 239/201 |
| 3,193,205 | A | | 7/1965 | Hanson | 239/276 |
| 3,353,770 | A | * | 11/1967 | Sondheim | 248/694 |
| 3,542,294 | A | | 11/1970 | Tucker | 239/201 |
| 3,762,642 | A | * | 10/1973 | Di Santo | 239/201 |
| 3,904,120 | A | | 9/1975 | Sbicca | 239/201 |
| 4,108,439 | A | | 8/1978 | McGuire | 273/176 |
| D256,386 | S | | 8/1980 | Bergland | D23/7 |
| 4,365,786 | A | | 12/1982 | Osteen | 254/30 |
| 4,717,099 | A | * | 1/1988 | Hubbard | 248/74.1 |
| 4,750,662 | A | | 6/1988 | Kagimoto | 228/44.5 |
| 4,906,131 | A | | 3/1990 | Savoka | 405/36 |
| 4,925,364 | A | * | 5/1990 | Das | 415/150 |
| 5,015,123 | A | | 5/1991 | Houck et al. | 405/45 |
| 5,310,281 | A | | 5/1994 | Elena | 405/39 |
| 5,368,265 | A | * | 11/1994 | Gueli | 248/214 |
| 5,458,435 | A | * | 10/1995 | Kohno | 404/25 |
| 5,538,361 | A | * | 7/1996 | Beamer | 405/118 |
| 6,119,784 | A | * | 9/2000 | MacDonald et al. | 248/214 |
| 6,152,651 | A | * | 11/2000 | Glidewell et al. | 405/36 |
| 6,186,416 | B1 | * | 2/2001 | Jones et al. | 239/288 |

FOREIGN PATENT DOCUMENTS

| | | | |
|---|---|---|---|
| FR | 1422293 | | 3/1966 |
| JP | 09000655 A | * | 1/1997 |
| JP | 10179784 A | * | 7/1998 |

* cited by examiner

*Primary Examiner*—Leslie A. Braun
*Assistant Examiner*—A. Joseph Wujciak, III
(74) *Attorney, Agent, or Firm*—Pennie & Edmonds LLP

(57) ABSTRACT

A sprinkler head installation tool and a method of using it comprising at least one elongated member adapted for spanning an opening in a ground surface area having a surface plane, the elongated member having at least one stabilizing component, and at least one holding member capable of releasably fixing at least one sprinkler head to the elongated member, said holding member being independently moveable along, and adjustably connected to the elongated member, to hold a top surface of the at least one sprinkler head in a fixed position within the opening and substantially level with the ground surface and while the opening is backfilled.

29 Claims, 3 Drawing Sheets

SPRINKLER HEAD INSTALLATION TOOL

FIELD OF THE INVENTION

The present invention generally relates to a novel tool to aid in grade leveled installation of a sprinkler head in the ground.

BACKGROUND OF THE INVENTION

Irrigation systems aid in keeping various plants, trees, and grasses thoroughly hydrated and, therefore, alive. Once limited solely to golf courses and a limited number of exclusive properties, various types of irrigation systems are becoming more and more commonplace. More specifically, in-ground sprinkler systems, similar to those found on thousands of golf courses worldwide, are now being regularly installed in public parks and land, farmland, flower-filled median strips and grassy knolls, and even in lawns of private homes.

Although sprinkler systems may be installed by mechanically-minded individuals, the job is usually reserved for professionals, as it can be very difficult to efficiently align the sprinkler heads and their associated parts into an effective network for proper hydration coverage. Irrigation piping, typically PVC piping, is placed in the ground and arranged in a network-type orientation so that water is properly and evenly distributed to the sprinkler heads and, subsequently, to the ground area to be watered. Sprinkler heads are next installed in large, pre-dug holes placed at specific predetermined locations throughout the irrigation pipe network. The sprinkler heads are attached to the piping and the holes are backfilled with dirt.

Installers of the sprinkler heads, including professionals, typically encounter one common problem during installation—proper alignment of the top surface of the sprinkler head with the surface of the ground. It is critical that the top of the sprinkler head be flush with the surface of the ground. If the sprinkler head is too high, persons can trip over it or it can be knocked over or clipped by mowers, both of which are very unsafe. Conversely, if the sprinkler head is too low, improper water distribution may result in poorly and unevenly watered areas.

A handful of patents are directed to various sprinkler related methods and inventions. For example, U.S. Design Pat. No. 256,386 discloses an ornamental design for a sprinkler shield.

U.S. Pat. No. 5,310,281 discloses a system for irrigating the roots of plants below the surface of the ground. A narrow irrigation tube is connected at its upper end to a Water distribution source. The irrigation tube extends below the surface of the ground and its lower end opens vertically downward below the roots of a plant so that water may be discharged in a downwardly direction.

U.S. Pat. No. 4,906,131 discloses a method for attaching a sprinkler head to the free end of a length of pipe which has been laid within a trench. The method includes excavating around the end of the pipe, cutting the free end of the pipe, connecting conduit, and subsequently connecting a sprinkler head.

U.S. Pat. No. 4,108,439 discloses a device and method for marking the position of and for protecting an in ground object, such as a sprinkler head, including a hollow, open-ended, tubular member which is adapted to be placed around the object and into the ground. An outwardly directed ring which includes a depending lip is formed integral with and adjacent the upper end of the member. The ring stabilizes the device and limits the depth of insertion of the tubular member.

U.S. Pat. No. 3,904,120 discloses a thick, plastic disc adapted to be recessed into a lawn about a sprinkler head to stabilize the latter and prevent grass blades from interfering with the operation of the sprinkler.

U.S. Pat. No. 3,542,294 discloses a support device for a horizontal main and a riser assembly projecting upwardly therefrom in a lawn sprinkler system.

U.S. Pat. No. 3,193,205 discloses a sprinkler system imbedded in the earth and, more particularly, a support for the sprinkler head and conduit used in such systems.

U.S. Pat. No. 152,825 discloses a perforated irrigation apparatus, laid in grooved furrows at or below the surface of the ground, and protected at points directly over the perforations by suitable shields.

Although there are numerous means for protecting and supporting sprinkler heads and irrigation components, there remains a need for a useful adjustably-mountable tool, and a method for using the same, to facilitate the mounting of a sprinkler head flush with the ground.

SUMMARY OF THE INVENTION

The present invention is directed to a sprinkler head installation tool comprising at least one elongated member adapted for spanning an opening in a ground surface area having a surface plane, the elongated member having at least one stabilizing component; and at least one holding member capable of releasably fixing at least one sprinkler head to the elongated member, said holding member being independently moveable along, and adjustably connected to the elongated member, to hold a top surface of the at least one sprinkler head in a fixed position substantially level or flush with the ground surface plane while the opening is backfilled.

In one embodiment, the elongated member is adjustable in length. In another embodiment, two holding members releasably fix the sprinkler head to the elongated member. In a further embodiment, the elongated member comprises two stabilizing components. In a preferred embodiment, the elongated member has two opposing ends each having the stabilizing component. In still another embodiment, the stabilizing component is a bar coupled to the elongated member such that the tool is T-shaped. In a preferred embodiment, the stabilizing component is a plurality of bars coupled to opposing ends of the elongated member such that the tool is H-shaped.

In a one embodiment, the holding member comprises a guide member and a means for securing the holding member. In another embodiment, the means for securing the holding member comprises a pin, a neck for receiving the pin, and a spring allowing adjustment of the holding member. In a further embodiment, the holding member further comprises a flange extending from the holding member for gripping the sprinkler head. Preferably, the flange has a length of at least about 0.25 inches.

The present invention is also directed to a sprinkler head installation tool comprising at least one spanning means for spanning an opening in a ground surface area defining a surface plane; at least one stabilizing means attached to the spanning means for stabilizing the spanning means; at least one holding means for holding at least one sprinkler head, said means being independently moveable along, and adjustably connected to the spanning means, to hold the at least one sprinkler head such that a top surface thereof is substantially in the surface plane while the opening is backfilled.

The present invention is further directed to a sprinkler head installation tool comprising at least one elongated member adapted for spanning an opening in a ground surface area having a surface plane, the elongated member having at least one stabilizing component; and at least one holding member capable of releasably fixing at least one sprinkler head to the elongated member, said holding member being independently moveable along, and adjustably connected to the elongated member, to hold a top surface of the at least one sprinkler head in a fixed position substantially level with the ground plane surface while the opening is backfilled.

In another embodiment, the at least one sprinkler head is substantially level to and a selected distance below the plane surface with the ground. In another embodiment, the elongated member is adjustable in length. In another embodiment, two holding members releasably fix the sprinkler head to the elongated member. In a further embodiment, the elongated member comprises two stabilizing components. In a preferred embodiment, the elongated member has two opposing ends having the stabilizing component. In still another embodiment, the stabilizing component is a bar coupled to the elongated member such that the tool is T-shaped. In a preferred embodiment, the stabilizing component is a plurality of bars coupled to opposing ends of the elongated member such that the tool is H-shaped.

In a further embodiment, the holding member comprises a guide member and a means for securing the holding member. In another embodiment, the means for securing the holding member comprises a pin, a neck for receiving the pin, and a spring allowing returnable translation of the holding member. In a further embodiment, the holding member further comprises a flange extending from the holding member for gripping the sprinkler head. Preferably, the flange has a length of at least about 0.25 inches.

The present invention is also directed to a method for installing a sprinkler head comprising the steps of providing at least one elongated member adapted for spanning an opening in a ground surface area having a surface plane, said member having at least one stabilizing component; providing at least one sprinkler head; providing at least one holding member capable of releasably fixing the at least one sprinkler head to the elongated member, said holding member being independently moveable along, and adjustably connected to the elongated member, to hold the at least one sprinkler head in a fixed position; attaching the elongated member to the at least one sprinkler head such that a top surface of the at least one sprinkler head is substantially level with the ground surface plane; backfilling the opening; and detaching the elongated member and the holding member from the at least one sprinkler head.

In one embodiment, the elongated member is adjustable in length. In another embodiment, two holding members releasably fix the sprinkler head to the elongated member. In a further embodiment, the elongated member comprises two stabilizing components. In a preferred embodiment, the elongated member has two opposing ends having the stabilizing component. In still another embodiment, the stabilizing component is a bar coupled to the elongated member such that the tool is T-shaped. In a preferred embodiment, the stabilizing component is a plurality of bars coupled to opposing ends of the elongated member such that the tool is H-shaped.

In a further embodiment, the holding member comprises a guide member and a means for securing the holding member. In another embodiment, the means for securing the holding member comprises a pin, a neck for receiving the pin, and a spring allowing returnable translation of the holding member. In a further embodiment, the holding member further comprises a flange extending from the holding member for gripping the sprinkler head. Preferably, the flange has a length of at least about 0.25 inches.

DESCRIPTION OF THE PREFERRED EMBODIMENTS

Figure 1:
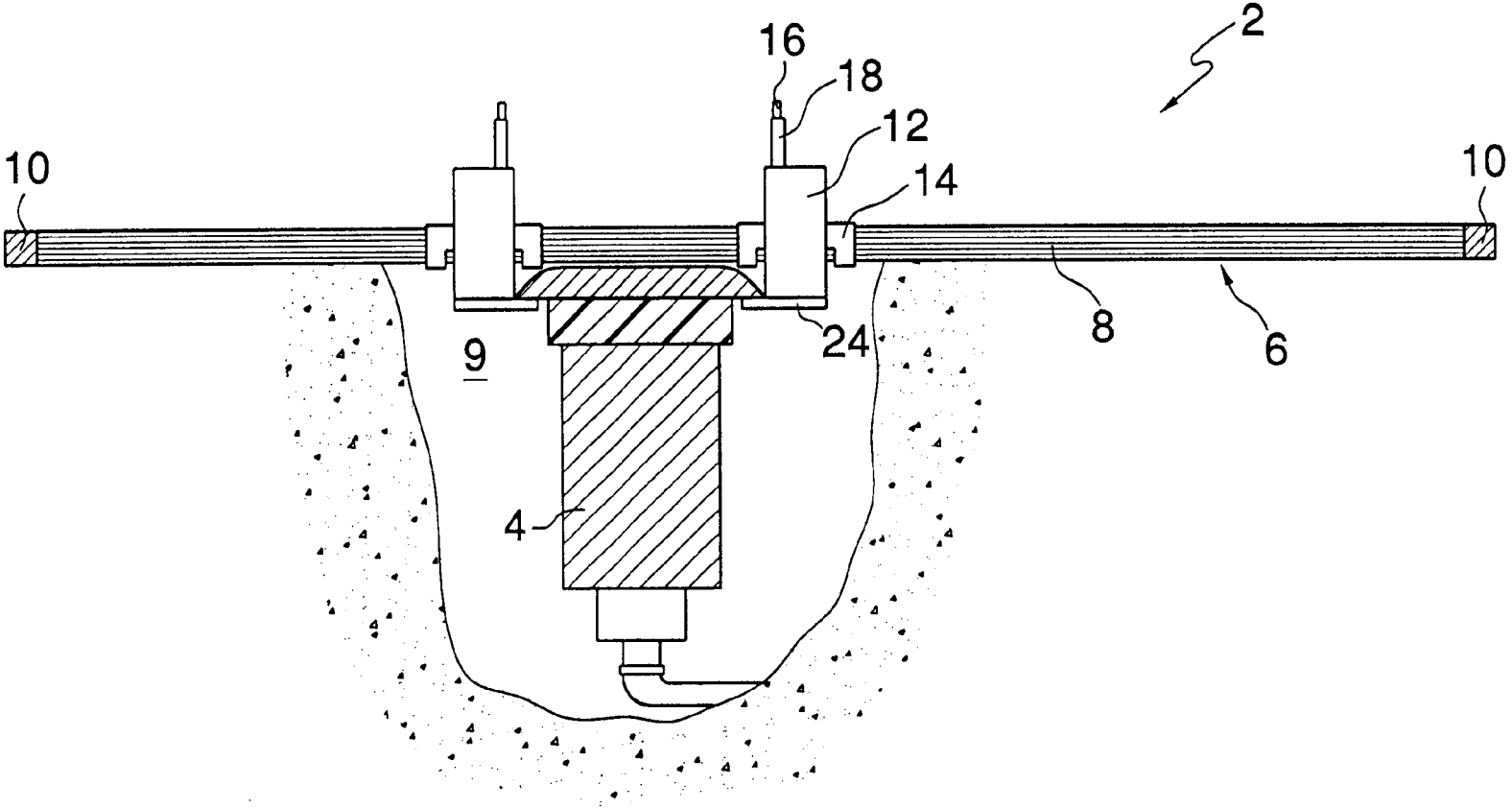
FIG. 1 is a side view of a preferred embodiment of an installed sprinkler head, held in place by a sprinkler head installation tool, according to the present invention.
Figure 2:
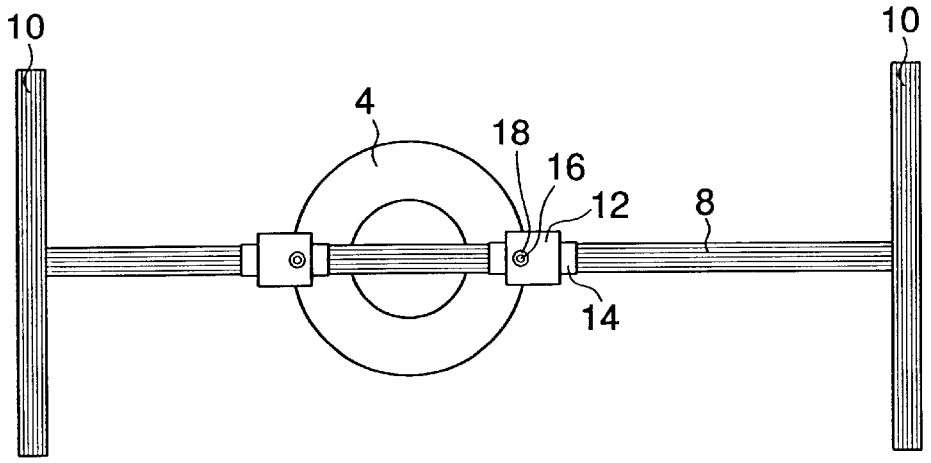
FIG. 2 is a top view of a sprinkler head installation tool, as shown in FIG. 1 according to the present invention, releasably attached to the top of a sprinkler head.
Figure 3:
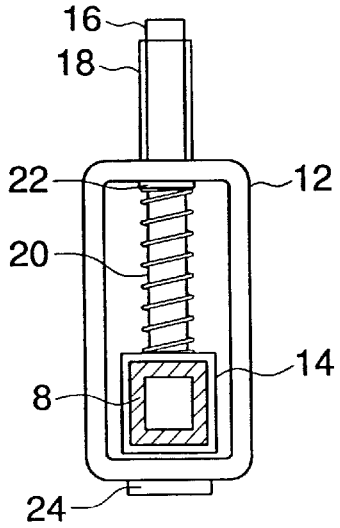
FIG. 3 is a cross section of the adjustable holding member.
Figure 4:
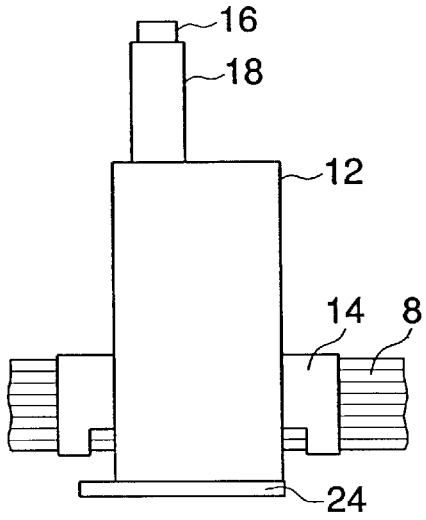
FIG. 4 is a side view of the adjustable holding member.

Referring to FIGS. 1–5, the present invention is directed to a sprinkler head installation tool 2. The tool 2 is intended for use in mounting a sprinkler head 4 flush with the surrounding ground surface 6.

The tool comprises at least one elongated member 8 that is adapted for spanning an opening 9 in the surrounding surface 6. The elongated member 8 may be constructed of any material capable of supporting the weight of a sprinkler head, such as steel, aluminum, plastic, or wood, and may be solid or hollow. Preferably, the elongated member 8 is constructed of solid aluminum tubing. The elongated member 8 may be any length and is preferably of unitary construction. In one embodiment, the elongated member 8 is adjustable (i e., telescoping) in such a manner as to allow the member 8 to have varying lengths as is known by those of ordinary skill in the art. The elongated member 8 may have any cross section but preferably has a cross section that is substantially rectangular, triangular, or square-shaped, such that it provides a flat plane surface to enable abutment of the top surface of the sprinkler head 4 while keeping the sprinkler head 4 in substantially the same plane as the surrounding surface 6. The surface is level with to the surrounding ground surface 6 and can more easily set the top surface of the sprinkler head 4 in the substantially the same plane as the ground surface 6.

The elongated member 8 has at least one stabilizing component 10 to aid in torsional stability (i.e., rotation about an axis co-linear with the elongated member 8). The stabilizing component 10 is preferably constructed unitarily with the elongated member 8, but may also be separately constructed and subsequently attached. The stabilizing component 10 is oriented at an angle different from the elongated member 8. For example, the stabilizing component 10 could be T-shaped, V-shaped, or arrowhead shaped. Preferably, the stabilizing component 10 is a bar coupled to the elongated member 8 such that the tool is T-shaped and is attached to at least one end of the elongated member 8. More preferably, the stabilizing component 10 is a plurality of bars coupled to opposing ends of the elongated member 8 such that the tool is H-shaped. Preferably, the length of the stabilizing component 10 is less than the elongated member 8.

The sprinkler head tool 2 additionally comprises at least one holding member 12 capable of releasably fixing at least one sprinkler head 4 to the elongated member 8. The holding member 12 comprises a guide member 14, a pin 16, a neck 18, a spring 20, a retaining washer 22, and a flange 24. The guide member 14 has a cross section that mates with the cross section of the elongated member 8, and slides along the elongated member 8 to allow adjustable position of the holding member 12 for adjustably mounting at least one sprinkler head 4. The guide member 14 may be of any construction, such as steel, aluminum, or plastic. Preferably, the guide member 14 is constructed of metal. The holding member 12 is secured to the elongated member 8 by a plurality of means. Preferably, the holding member 12 is secured by a combination of the pin 16 that slides co-linearly through a neck 18 in the top of the holding member 12. More preferably, positive and therefore securing resistance to the holding member 12 is provided by the combination of a pre-loaded spring 20 and a washer 22. The combination of the spring 20 and the washer 22 allow the holding member to translate in a direction perpendicular to the ground surface plane so that sprinkler heads 4, having various thicknesses, may be held such that the top surface abuts the bottom surface of the elongated member 8.

The holding member 12 additionally comprises a flange 24 for cupping underneath the top of the sprinkler head 4 and holding the top surface thereof against the elongated member 8. The flange may be constructed of any material capable of supporting the sprinkler head 4, such as steel, aluminum, or plastic. Preferably, the flange 24 is constructed of metal. The flange 24 must be long enough to provide securable support of the top of the sprinkler head 4. Preferably, the flange 24 is projected from and parallel to the holding member 12 about 0.25 inches to about 2 inches in length. More preferably, the flange 24 is about 0.5 inches to about 1 inch in length.

Figure 5:
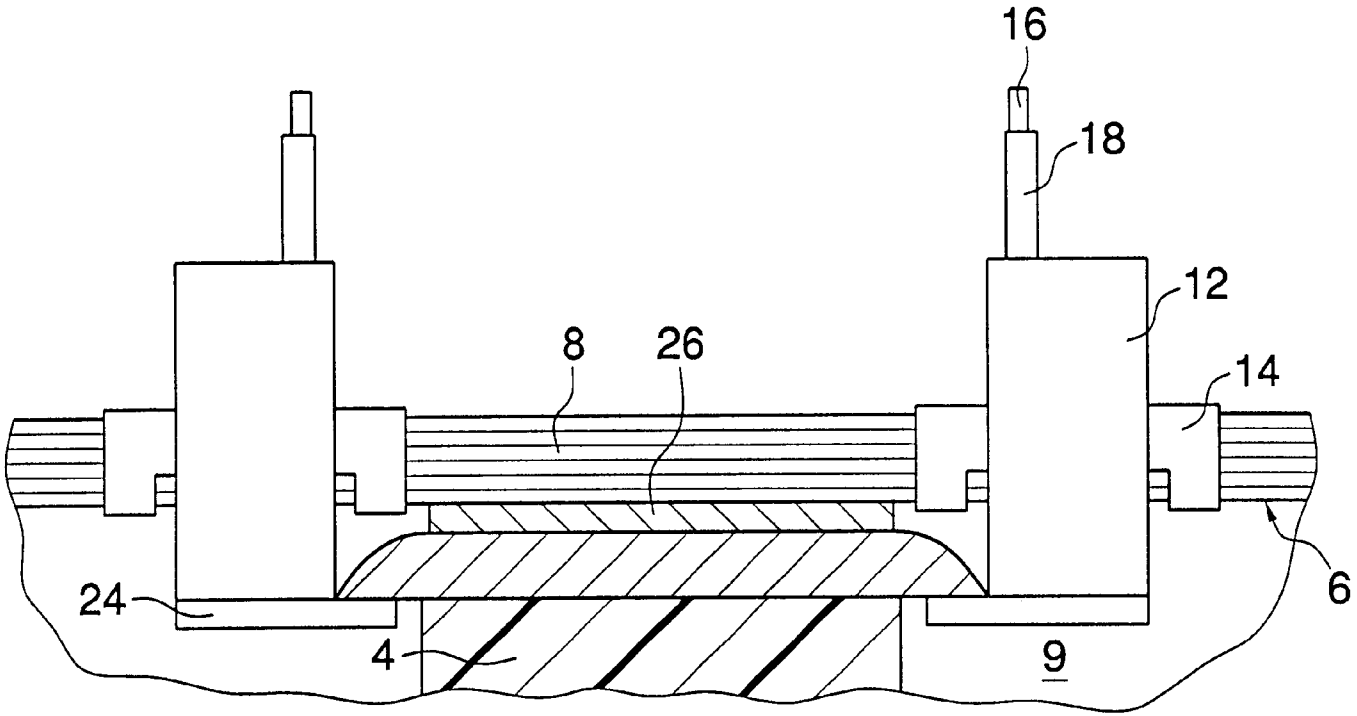
FIG. 5 is a second embodiment of the present invention.

Referring to FIG. 5, in another embodiment of the present invention, the elongated member 8 comprises a flat spacer 26 that allows the sprinkler head 4 to be inserted in an opening in the ground 9 in a manner such that the plane defined by the top surface of the sprinkler head 4 is parallel to and below the ground surface plane of the surrounding surface 6.

The invention is also directed to a method for installing a sprinkler head such that the top of the sprinkler head is substantially in the same plane with the surface of the ground in which it is being installed. The steps include providing at least one elongated member adapted for spanning an opening in the ground, wherein the member has at least one stabilizing component, attaching a sprinkler head to a swing joint that is attached to an irrigation pipe in the ground, placing the elongated member on the surface of the ground such that the sprinkler head 4 may be attached, and backfilling the opening. Preferably, the elongated member 8 has a planar surface substantially parallel to the ground and the top of the sprinkler head 4 is coupled against the planar surface such that the top of the sprinkler head 4 is substantially in the same plane as the ground. Preferably, the elongated member 8 has two stabilizing members 10 located at opposing ends. More preferably, the stabilizing members 10 are perpendicular to the elongated member 8 and are located at opposing ends of the elongated member 8.

The mounting tool 2 is placed over a hole in the ground that has been dug at a predetermined position over a water source. The sprinkler head 4 is preferably attached to a swing joint and, additionally, an irrigation pipe, prior to attaching the mounting tool 2.

The elongated member 8 is attached to the sprinkler head 4 by the at least one holding member 12. In a preferred embodiment, two holding members 12 are employed per sprinkler head 4 and secure the sprinkler head 4 by converging, clamping movement along the length of the elongated member 8. The translating and subsequent securing of the sprinkler head 4 is accomplished by downward pressure on the holding member 12, which compresses the spring 20, allowing the at least one holding member 12 and flange 24 to translate away from the elongated member 8. In the compressed position, the at least one holding member can be additionally translated along the elongated member 8 such that the flange 24 can extend underneath, close against, and grip the top of the sprinkler head 4. When pressure on the holding member 12 is released, the spring 20 exerts upward pressure on the holding member 12 and flange 24, thereby securing the sprinkler head 4 against said elongated member 8.

The elongated member 8 spans the hole in the ground, holding the sprinkler head 4 in substantially the same plane with the surface of the ground. The at least one stabilizing member 10 help keep the sprinkler head 4 in substantially the same plane with the ground by not allowing the elongated member 8 to rotate about its axis. The hole is backfilled with any appropriate substance, preferably dirt. The mounting tool 2 is removed from the sprinkler head 4 by loosening the holding means 12 and spreading said holding means 12 apart and away from the sprinkler head 4.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed:

1. A sprinkler head installation tool comprising:

at least one elongated member adapted for spanning an opening in a ground surface area having a surface plane, the elongated member having at least one stabilizing component; and first and second holding members selectively and independently positionable along the elongated member, the first and second holding members being provided with respective first and second abutment surfaces and respective first and second springs, the first and second springs arranged to bias corresponding first and second abutment surfaces in a first direction, so that the holding members are capable of releasably fixing at least one sprinkler head relative to the elongated member by maintaining a top surface of the at least one sprinkler head in a fixed position.

2. The tool of claim 1, wherein the elongated member is adjustable in length.

3. The tool of claim 1, wherein the elongated member comprises two stabilizing components.

4. The tool of claim 1, wherein the elongated member has two opposing ends, each having the stabilizing component.

5. The tool of claim 1, wherein the stabilizing component is a bar coupled to the elongated member such that the tool is T-shaped.

6. The tool of claim 1, wherein the stabilizing component is a plurality of bars coupled to opposing ends of the elongated member such that the tool is H-shaped.

7. The tool of claim 1, wherein each holding member comprises a guide member and means for securing the holding member.

8. The tool of claim 1, wherein the first and second abutment surfaces are formed on respective first and second flanges extending towards each other from respective first and second holding members.

9. The tool of claim 8, wherein the flange has a length of at least about 0.25 inches.

10. The tool of claim 1, wherein the first and second abutment surfaces face said elongated member.

11. A sprinkler head installation tool comprising:

at least one elongated member adapted for spanning an opening in a ground surface area having a surface plane, the elongated member having at least one stabilizing component; and first and second holding members selectively and independently positionable along the elongated member, the first and second holding members being provided with respective first and second abutment surfaces, so that the holding members are capable of releasably fixing at least one sprinkler head relative to the elongated member by maintaining a top surface of the at least one sprinkler head in a fixed position;

wherein each holding member comprises a guide member and means for securing the holding member, and wherein the means for securing the holding member comprises a pin, a neck for receiving the pin, and a spring allowing returnable translation of the holding member.

12. A sprinkler head installation tool comprising:

at least one spanning means for spanning an opening in a ground surface area having a surface plane;

at least one stabilizing mean s attached to the spanning means for stabilizing the spanning means;

at least one holding means for holding at least one sprinkler head, said holding means being independently moveable along, and adjustably connected to the spanning means, said holding means including spring means arranged to bias an abutment surface in a first direction so as to releasably hold the at least one sprinkler head such that a top surface thereof is substantially level with the ground surface plane while the opening is backfilled.

13. A sprinkler head installation tool comprising:

at least one elongated member adapted for spanning an opening in a ground surface area having a surface plane, the elongated member having at least one stabilizing component; and first and second holding members selectively and independently positionable along the elongated member, the first and second holding members being provided with respective first and second abutment surfaces, so that the holding members are capable of releasably fixing at least one sprinkler head relative to the elongated member by maintaining a top surface of the at least one sprinkler head in a fixed position;

wherein the first and second abutment surfaces are formed on respective first and second flanges extending towards each other from respective first and second holding members; and wherein the elongated member further comprises a spacer positioned between the first and second holding members, wherein the spacer is adapted to vertically position the at least one sprinkler head relative to an adjacent ground surface area, when the at least one elongated member spans an opening in said adjacent ground surface area.

14. A sprinkler head installation tool comprising:

at least one elongated member adapted for spanning an opening in a ground surface area having a surface plane, the elongated member having at least one stabilizing component; and at least one holding member independently positionable along the elongated member and configured to position at least one sprinkler head relative to the elongated member, wherein the holding member comprises a guide member and means for securing the holding member to the elongated member, the means for securing comprising a pin, a neck for receiving the pin, and a spring allowing returnable translation of the holding member, so that the holding member is capable of releasably fixing at least one sprinkler head relative to the elongated member by maintaining a top surface of the at least one sprinkler head in a fixed position.

15. A sprinkler head installation tool comprising:

at least one elongated member adapted for spanning an opening in a ground surface area having a surface plane, the elongated member having at least one stabilizing component; and at least one holding member independently positionable along the elongated member and comprising at least one flange extending therefrom, the at least one flange being provided with at least one abutment surface facing the elongated member, the holding member further comprising at least one spring arranged to bias the at least one abutment surface in a first direction, so that the holding member is capable of releasably fixing at least one sprinkler head relative to the elongated member by maintaining a top surface of the at least one sprinkler head in a fixed position.

16. A sprinkler head installation tool in combination with a sprinkler head, comprising:

at least one elongated member adapted for spanning an opening in a ground surface area having a surface plane, the elongated member having at least one stabilizing component;

at least one holding member selectively and independently positionable along the elongated member and being provided with at least one abutment surface, so that the holding member is capable of releasably fixing the sprinkler head relative to the elongated member by maintaining a top surface of the sprinkler head in a fixed position in preparation for installing the sprinkler head in an opening in a ground surface area.

17. The tool of claim 16, wherein the elongated member is resting on a ground surface area in a position spanning an opening therein and the sprinkler head is suspended within the opening in a desired position for installation.

18. The tool of claim 17, wherein the sprinkler head is maintained in the desired position while the opening is filled.

19. The tool of claim 18, wherein the tool is separated from the sprinkler head after the opening is filled.

20. The tool of claim 16, wherein the elongated member is adjustable in length.

21. The tool of claim 16, wherein the elongated member comprises two stabilizing components.

22. The tool of claim 16, wherein the elongated member has two opposing ends, each having the stabilizing component.

23. The tool of claim 16, wherein the stabilizing component is a bar coupled to the elongated member such that the tool is T-shaped.

24. The tool of claim 16, wherein the stabilizing component is a plurality of bars coupled to opposing ends of the elongated member such that the tool is H-shaped.

25. The tool of claim 16, wherein the at least one holding member comprises a guide member in a configuration which allows the at least one the holding member to travel along a length of the elongated member.

26. The tool of claim 25, wherein the at least one holding member further comprises means for securing the holding member.

27. The tool of claim 26, wherein the means for securing the holding member comprises a pin, a neck for receiving the pin, and a spring allowing returnable translation of the holding member.

28. The tool of claim 16, wherein the at least one abutment surface is formed on a laterally extending flange.

29. The tool of claim 28, wherein the flange has a length of at least about 0.25 inches.

* * * * *